US008519607B2

(12) United States Patent
Kowalski et al.

(10) Patent No.: US 8,519,607 B2
(45) Date of Patent: Aug. 27, 2013

(54) SPARK PLUG ELECTRODE CONFIGURATION

(75) Inventors: Kevin J. Kowalski, Perrysburg, OH (US); Richard L. Keller, Whitehouse, OH (US); Frederick J. Quitmeyer, Rochester Hills, MI (US); Richard Llope, Franklin, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/535,505

(22) Filed: Jun. 28, 2012

(65) Prior Publication Data

US 2013/0002122 A1 Jan. 3, 2013

Related U.S. Application Data

(60) Provisional application No. 61/502,106, filed on Jun. 28, 2011, provisional application No. 61/504,446, filed on Jul. 5, 2011.

(51) Int. Cl.
*H01T 13/20* (2006.01)

(52) U.S. Cl.
USPC ..... 313/142; 313/141; 313/118

(58) Field of Classification Search
USPC ..... 313/141, 142
See application file for complete search history.

(56) References Cited

U.S. PATENT DOCUMENTS

| | | | | |
|---|---|---|---|---|
| 5,202,601 | A | 4/1993 | Takamura et al. | |
| 5,465,022 | A | 11/1995 | Katoh et al. | |
| 5,488,262 | A | 1/1996 | Takamura | |
| 5,563,469 | A | 10/1996 | Takamura et al. | |
| 5,574,329 | A * | 11/1996 | Kagawa | 313/141 |
| 5,982,080 | A | 11/1999 | Shibata et al. | |
| 6,307,307 | B1 * | 10/2001 | Kanao | 313/142 |
| 6,337,533 | B1 * | 1/2002 | Hanashi et al. | 313/141 |
| 6,621,198 | B2 | 9/2003 | Kanao et al. | |
| 6,642,638 | B2 | 11/2003 | Ishiguro | |
| 6,653,767 | B2 | 11/2003 | Morita et al. | |
| 6,676,468 | B2 | 1/2004 | Ishiguro et al. | |
| 6,710,523 | B2 | 3/2004 | Segawa et al. | |

(Continued)

FOREIGN PATENT DOCUMENTS

| | | | |
|---|---|---|---|
| WO | WO2010117780 | A2 | 10/2010 |
| WO | WO2011066406 | A2 | 6/2011 |

OTHER PUBLICATIONS

Written Opinion & International Search Report for PCT/US12/044594, Jan. 28, 2013, 10 pages.

*Primary Examiner* — Mary Ellen Bowman
(74) *Attorney, Agent, or Firm* — Reising Ethington P.C.

(57) ABSTRACT

A spark plug includes an electrode tip assembly located at an axially-facing free end surface of an electrode body. The electrode tip assembly includes an electrode tip body and a firing tip and has a longitudinal axis that is generally perpendicular to a longitudinal axis of the electrode body. The electrode tip body may be a Ni-alloy piece and is attached to the electrode body, and the firing tip may be an Ir-alloy piece with a sparking surface that faces a spark gap. The electrode body may include a groove formed in the axially-facing free end surface that is useful to help position the electrode tip assembly for attachment. The spark gap can be formed between opposing electrode tip assemblies, and the size of the spark gap can be adjusted during assembly without the need for bending the electrode body.

15 Claims, 3 Drawing Sheets

(56) References Cited

U.S. PATENT DOCUMENTS

| | | | | |
|---|---|---|---|---|
| 6,720,716 | B2 | 4/2004 | Shibata et al. | |
| 6,750,598 | B2 | 6/2004 | Hori | |
| 6,923,699 | B2 | 8/2005 | Matsubara et al. | |
| 7,105,990 | B2 | 9/2006 | Shibata et al. | |
| 7,145,287 | B2 | 12/2006 | Kato | |
| 7,652,413 | B2 | 1/2010 | Kawashima | |
| 7,666,047 | B2 | 2/2010 | Suzuki et al. | |
| 7,808,165 | B2 | 10/2010 | Kowalski | |
| 2007/0216276 | A1* | 9/2007 | Takada | 313/141 |
| 2009/0066211 | A1 | 3/2009 | Hartmann et al. | |
| 2009/0127997 | A1 | 5/2009 | Kameda et al. | |
| 2009/0134764 | A1 | 5/2009 | Kameda et al. | |
| 2009/0140624 | A1 | 6/2009 | Kameda et al. | |
| 2009/0160304 | A1 | 6/2009 | Kameda et al. | |
| 2009/0302733 | A1 | 12/2009 | Nunome et al. | |
| 2009/0309474 | A1 | 12/2009 | Nunome | |
| 2010/0264796 | A1 | 10/2010 | Musasa et al. | |
| 2010/0264801 | A1 | 10/2010 | Tanaka et al. | |
| 2010/0264802 | A1 | 10/2010 | Tanaka et al. | |
| 2010/0264803 | A1 | 10/2010 | Nunome et al. | |
| 2010/0264804 | A1 | 10/2010 | Kameda et al. | |
| 2010/0320893 | A1 | 12/2010 | Kato | |
| 2010/0322198 | A1 | 12/2010 | Friday et al. | |

* cited by examiner

SPARK PLUG ELECTRODE CONFIGURATION

REFERENCE TO RELATED APPLICATIONS

This application claims the benefit of U.S. Provisional Ser. No. 61/502,106 filed on Jun. 28, 2011 and U.S. Provisional Ser. No. 61/504,446 filed Jul. 5, 2011, the entire contents of both applications are incorporated herein.

TECHNICAL FIELD

This invention generally relates to spark plugs and other ignition devices for internal combustion engines and, in particular, to electrode configurations for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug, including a metallic shell having an axial bore, an insulator having an axial bore and being at least partially disposed within the axial bore of the metallic shell, and a center electrode being at least partially disposed within the axial bore of the insulator. The center electrode includes a center electrode body having a longitudinal axis and an axially-facing free end surface. The spark plug also includes a ground electrode attached to the metallic shell. The ground electrode includes a ground electrode body having a longitudinal axis and an axially-facing free end surface. An electrode tip assembly is attached to the axially-facing free end surface of the center electrode body or the ground electrode body. The electrode tip assembly has a longitudinal axis that is generally perpendicular to the longitudinal axis of the respective electrode body to which it is attached. The electrode tip assembly includes an electrode tip body attached to the respective electrode body and a noble metal firing tip attached to the electrode tip body and facing a spark gap.

According to one embodiment, there is provided a method of making a spark plug, comprising the steps of: (a) providing a Ni-alloy piece, an Ir-alloy piece, and an electrode body, the electrode body having a longitudinal axis; (b) welding the Ni-alloy piece and the Ir-alloy piece together to form an electrode tip assembly having a longitudinal axis; and (c) welding the Ni-alloy piece to an axially-facing free end surface of the electrode body so that the longitudinal axis of the electrode tip assembly is generally perpendicular to the longitudinal axis of the electrode body.

According to another embodiment, there is provided a method of making a spark plug, including the steps of: (a) welding first and second Ni-alloy pieces to opposite ends of an Ir-alloy piece to form an electrode tip assembly pre-form having a longitudinal axis; (b) welding the first Ni-alloy piece to an axially-facing free end surface of a center electrode body so that the longitudinal axis of the pre-form is generally perpendicular to a longitudinal axis of the center electrode body; (c) welding the second Ni-alloy piece to an axially-facing free end of a ground electrode body; and (d) cutting through the Ir-alloy piece to form separate electrode tip assemblies having opposing sparking surfaces separated by a spark gap.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
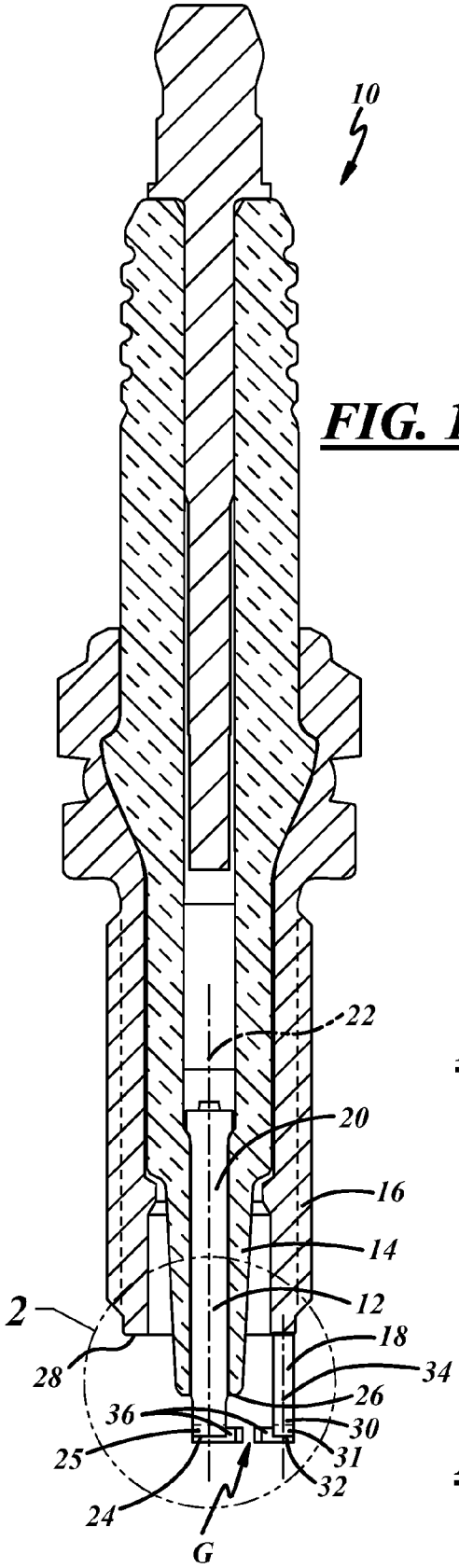
FIG. 1 is a cross-sectional view of an spark plug having an electrode configuration according to one embodiment.

The electrode configurations described herein may be used in spark plugs and other ignition devices including industrial plugs, aviation igniters, or any other device that is used to ignite an air/fuel mixture in an engine. This includes, but is certainly not limited to, the exemplary spark plugs that are shown in the drawings and that are described below.

Referring to FIG. 1, there is shown an exemplary spark plug 10 that includes a center electrode 12, an insulator 14, a metallic shell 16, and a ground electrode 18. The center electrode 12 is at least partially disposed within an axial bore of the insulator 14 and includes a center electrode body 20 having a longitudinal axis 22 and an axially-facing free end surface 24 at a free end 25 that is located axially beyond a free end 26 of the insulator 14. Insulator 14 is disposed within an axial bore of the metallic shell 16 and is constructed from a material, such as a ceramic material, that is sufficient to electrically insulate the center electrode 12 from the metallic shell 16. The free end 26 of the insulator 14 may protrude beyond a free end 28 of the metallic shell 16, as shown, or it may be retracted within the metallic shell 16. The ground electrode 18 is attached to the free end 28 of the metallic shell 16 and includes a ground electrode body 30 that extends to a free end 31 having a free end surface 32. The ground electrode body 30 has a longitudinal axis 34 that is generally parallel with the longitudinal axis 22 of the center electrode body 20. In the illustrated embodiment, the longitudinal axis 34 of the ground electrode body passes through is generally perpendicular to the free end surface 32. In this case, the free end surface 32 is an axially-facing free end surface, meaning that the surface 32 is generally facing in the same direction as the longitudinal axis 34. In other embodiments, the ground electrode body 30 may have a free end surface that is generally parallel with a longitudinal axis of the spark plug or with the longitudinal axis 22 of the center electrode body 20. The free end surface 32 may be tilted as much as 45 degrees from perpendicular with respect to the longitudinal axis 34 and be considered an axially-facing free end surface.

Figure 2:
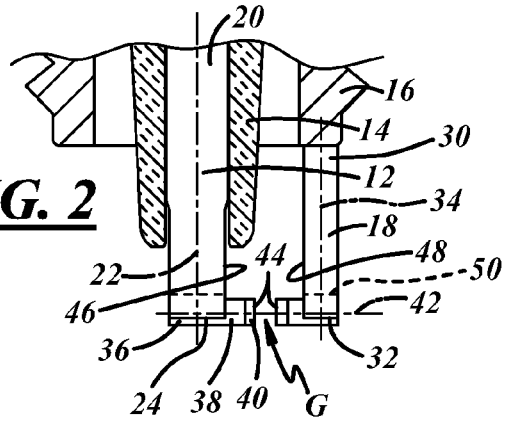
FIG. 2 is an enlarged view of the firing end of the exemplary spark plug from FIG. 1.

Each of the center electrode 12 and the ground electrode 18 in the illustrated embodiment also includes an electrode tip assembly 36. Referring to FIG. 2, where only the center electrode tip assembly 36 and its components are labeled for simplicity, each electrode tip assembly 36 includes two pieces 38 and 40 attached together. Piece 38 is an electrode tip body, and piece 40 is a firing tip. In one embodiment, the electrode tip body 38 is a nickel-alloy (Ni-alloy) piece 38, and the firing tip 40 is an iridium-alloy (Ir-alloy) piece 40. The electrode tip body 38 and the firing tip 40 are attached together by a weld, such as a laser weld, or by any other suitable means. The electrode tip body 38 may be constructed from Ni20Cr or any other suitable alloy. The firing tip 40 may be constructed from a noble metal or any other material suitable for use as a sparking surface material. As used herein, a noble metal includes any pure noble metal (e.g., iridium platinum, ruthenium, rhodium or palladium) or any metal alloy having a noble metal as the major constituent. Each electrode tip assembly 36 has a longitudinal axis 42 that is generally perpendicular to the longitudinal axes 22 and 34 of the center and ground electrode bodies. Each electrode tip assembly 36 is located at the axially-facing free end surface of the respective electrode body. In the embodiment shown, one tip assembly 36 is located at the axially-facing free end surface 24 of the center electrode body 20, and the other tip assembly is located at the axially-facing free end surface 32 of the ground electrode body 30. Each electrode tip assembly 36 is attached to its respective electrode body 20 or 30 by one or more welds, such as resistance and/or laser welds, or by other suitable means. More specifically, at least a portion of each electrode tip body 38 may be welded to its respective electrode body, as shown. The resulting electrodes 12, 18 formed from electrode bodies 20, 30 and attached electrode tip assemblies 36 do not include any bends in the electrode materials and may be referred to as non-bent or bendless electrodes. Non-bent electrodes may be characterized by the absence of bends formed during the manufacturing process, such as any bends of more than about 10° from straight. As discussed further below, these types of electrodes can be useful for the formation of more accurate spark plug gap dimensions during spark plug assembly and may also have reduced amounts of residual stress than electrodes that are bent during the manufacturing process.

As shown in FIG. 2, the two electrode tip assemblies 36 may oppose one another across a spark gap G. More specifically, the firing tips 40 of both of the electrode tip assemblies 36 include sparking surfaces 44 that oppose one another across the spark gap G. Each of the sparking surfaces 44 may be generally parallel with and may also be radially spaced from the longitudinal axis of the respective electrode body so that the spark gap G is an offset spark gap. An offset spark gap is a spark gap that is radially spaced away from the longitudinal axis 22 of the center electrode body 20—i.e., the longitudinal axis 22 does not pass through an offset spark gap or the sparking surfaces 44. Each of the sparking surfaces 44 may also be radially spaced away from the longitudinal axis of the respective electrode body to a location beyond electrode body side surfaces, such as side surface 46 of the center electrode body 20 and side surface 48 of the ground electrode body 30. The longitudinal axes 22 and 34 of the pair of electrode tip assemblies are generally parallel and may be a common axis as shown. To aid in positioning and alignment of the electrode tip assembly or assemblies during attachment, each of the axially-facing free end surfaces 24 and 32 of the illustrated embodiment may include a groove 50 formed therein, shown as a hidden line in FIG. 2 and shown in FIG. 3 in a cross-section transverse to the cross-section of FIG. 2. Each groove 50 may be formed in the same general direction as and have a longitudinal axis that is parallel to the longitudinal axis of the electrode tip assembly that it supports. Groove 50 may have a V-shaped cross-section that supports an electrode tip assembly having a circular cross-section, or the groove 50 may have another cross-section such as a rectangular, semi-circular or U-shaped cross-section, some examples of which are described below. Likewise, the electrode tip assembly 36 may have a non-circular cross-section.

Figure 3:
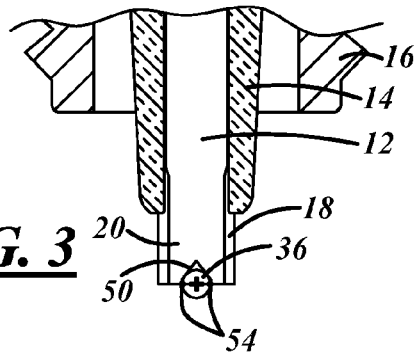
FIG. 3 is a transverse cross-section of the firing end of the exemplary spark plug of FIG. 2.

Though the embodiment of FIGS. 1-3 includes electrode tip assemblies 36 attached to both electrode bodies 20 and 30, other embodiments may have a center or a ground electrode that does not include a multi-piece electrode tip assembly. For example, the center electrode 12 may include an electrode tip assembly 36 as shown and the multi-piece tip assembly may be omitted from the ground electrode 18. In such an embodiment, the spark gap may be formed between the sparking surface 44 of the center electrode tip assembly and the side surface 48 of the ground electrode body or some other surface, such as a radially-facing ground electrode free end surface or the surface of a different type of electrode tip attached to the ground electrode body 30. Similarly, electrode tip assembly 36 may be included only with ground electrode 18 such that the spark gap is formed between tip assembly 36 and some other surface of the center electrode.

Figure 4:
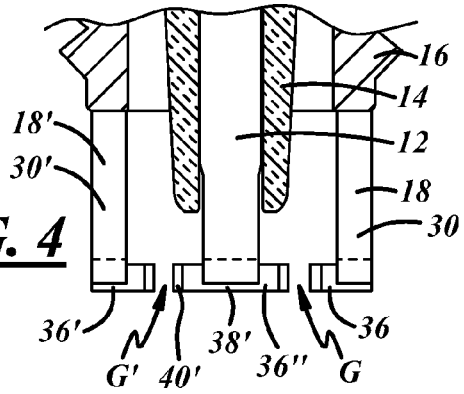
FIG. 4 is an enlarged view of the firing end of another exemplary spark plug having another electrode configuration.

FIG. 4 shows one embodiment of a spark plug that includes an additional ground electrode 18' on the opposite side of the center electrode 12 from ground electrode 18. In this embodiment, the additional ground electrode 18' includes a ground electrode body 30' and an electrode tip assembly 36', configured in generally the same manner as electrode body 30 and tip assembly 36 to form a second spark gap G' as shown. In this case, the center electrode tip assembly 36" includes a longer electrode tip body 38' and further includes an additional firing tip 40' attached at an end of the electrode tip body 38' opposite an end where the firing tip 40 is attached. Alternatively, the electrode tip assembly 36" may be two separate pieces, each including an electrode tip body and a firing tip, with the firing tips having sparking surfaces that form spark gaps with the ground electrode tip assembly sparking surfaces.

Figure 5:
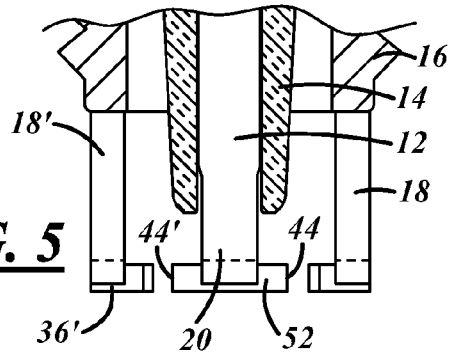
FIG. 5 is an enlarged view of the firing end of another exemplary spark plug having yet another electrode configuration.

FIG. 5 shows another embodiment that includes two ground electrodes 18 and 18' as in FIG. 4, each including respective multi-piece electrode tip assemblies 36 and 36'. In this embodiment, the center electrode 12 includes an electrode tip 52 located at the axially-facing free end surface of electrode body 20 that includes only a single piece of electrode tip material welded to the center electrode body 20. In one embodiment, the electrode tip 52 is made from a Ni-alloy material. In other embodiments, the electrode tip 52 may be made from other materials, such as an Ir-alloy, a material that includes one or more precious or noble metals, or a material that does not include precious or noble metal. Electrode tip 52 includes sparking surfaces 44 and 44' at its opposite free ends as shown. Of course, the above examples are exemplary and non-limiting. The spark plug may include any number of ground electrodes arranged around the center electrode, each electrode may or may not include a multi-piece electrode tip assembly or a single piece electrode tip located at the axially-facing free end surface of the respective electrode body, and each electrode may include additional components to form additional or alternative sparking surfaces or for other reasons.

An exemplary method of making a spark plug includes the step of welding a Ni-alloy piece and an Ir-alloy piece together to form an electrode tip assembly and the step of welding the Ni-alloy piece to an axially-facing free end surface of an electrode body so that a longitudinal axis of the tip assembly is generally perpendicular to a longitudinal axis of the electrode body. The electrode body may include the center electrode body and/or one or more ground electrode bodies. The method may also include forming a groove in the axially-facing free end surface of the center electrode body or the ground electrode body for supporting the electrode tip assembly before welding the Ni-alloy piece to the electrode body.

The Ni- and Ir-alloy pieces may be obtained by cutting the pieces to length from the desired material, which may be provided in the form of a wire—i.e., a form of material having a generally constant and continuous cross-section, such as a circular, square, triangular, or other cross-section, along its length. Of course, other techniques may be used to form the individual electrode tip assembly pieces such as powder metallurgy or other techniques that can provide preformed pieces. The pieces may be attached together by welding, such as laser welding or resistance welding, or by other known metal joining techniques. Each of the Ni- and Ir-alloy materials preferably has the same general cross-section, but it is possible to form the electrode tip assembly from pieces having different cross-sectional shapes or sizes. The step of welding the Ni-alloy piece to the electrode body may be accomplished by similar welding or metal joining processes. Exemplary welds 54 are shown in FIG. 5 where the Ni-alloy piece 38 contacts the free end surface of the center electrode body 20. The welds 54 in this case are shown along the groove 50, but may also be located at least partially outside of the groove 50. In one embodiment, the step of forming the groove 50 is omitted, and Ni-alloy piece is attached to a flat free end surface.

Figure 6:
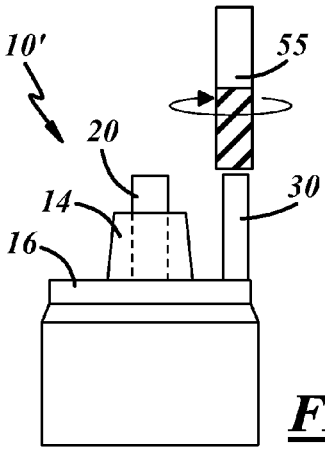
FIG. 6 is a front view of the firing end of an exemplary spark plug subassembly during a milling operation.
Figure 7:
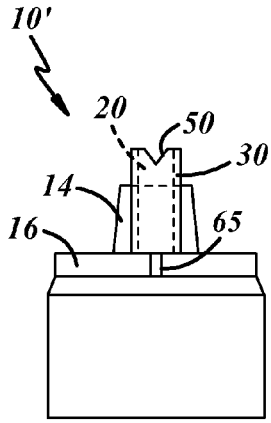
FIG. 7 is a side view of the spark plug subassembly of FIG. 6, shown after a groove is formed at an electrode free end.

FIGS. 6-10 show example steps for making a spark plug from a spark plug subassembly. FIG. 6 is a front view of the firing end of an exemplary spark plug subassembly 10' including center electrode body 20, insulator 14, metallic shell 16, and ground electrode body 30. As assembled, the center and ground electrode bodies may have free ends in different parallel planes—i.e., they may extend different distances beyond the insulator 14, for example. In FIG. 6, a step that includes forming the center and ground electrode bodies to the desired length is shown. In this embodiment, the ground electrode body 30 is cut so that its axially-facing free end surface is in the same plane as the axially-facing free end surface of the center electrode body 20. This step may be accomplished by milling, cutting, grinding, or other metal forming or removal techniques. FIG. 6 shows an exemplary end-milling operation performed with cutting tool 55. The center electrode body 20 may be cut instead of or in addition to the ground electrode body 30. FIG. 7 is a right side view of the subassembly of FIG. 6 after the step of forming groove 50 in the free end surfaces of each electrode body. This step may be also be performed formed by milling, cutting, grinding, or other metal forming or removal techniques. Also shown in FIG. 7 is a rotational positioning feature 65, discussed in further detail below.

Figure 8:
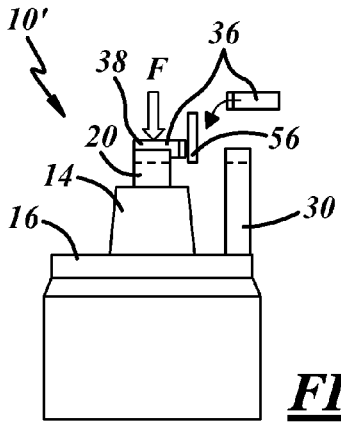
FIG. 8 is a front view of the spark plug subassembly of FIGS. 6 and 7, showing a gap tool being used to size a spark gap.

FIG. 8 is the front view of the subassembly 10' showing an electrode tip assembly 36 placed along the axially-facing free end surface of the center electrode body 20, in this case along groove 50. More specifically, Ni-alloy piece 38 is supported by the free end surface of the center electrode body 20, and a clamping force F is applied using a blade clamp or other suitable clamping apparatus. The ground electrode tip assembly is shown above the ground electrode body about to be placed into position for assembly. In this embodiment, a gap tool 56 is placed at the desired gap location for the sparking surfaces of the respective electrode tip assemblies to be placed against to set the size of the spark gap. The gap tool may be brought into position before placement of either of the electrode tip assemblies or after one of the tip assemblies is clamped in place, and either tip assembly may be placed first. In other embodiments, no gap tool is used and the spark gap is set by other suitable techniques such as automated placement of the electrode tip assemblies to pre-programmed locations, methods including optical feedback, etc.

Figure 9:
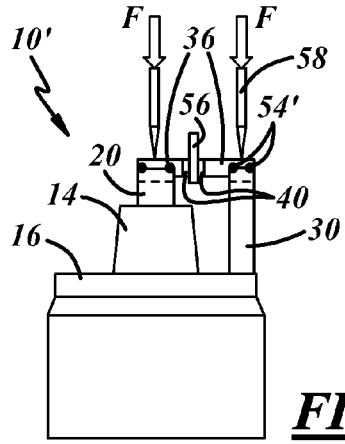
FIG. 9 is a front view of the spark plug subassembly of FIG. 8, showing tack welded electrode tip assemblies.

FIG. 9 shows subassembly 10' after both electrode tip assemblies 36 are in the desired location with Ir-alloy pieces 40 properly and accurately spaced apart via the gap tool 56. Clamping forces F are applied to both of the electrode assemblies to hold them in place. In the illustrated clamping step, blade clamps 58 are used to apply the clamping forces, though other types of clamps and/or clamp geometries may be used. The clamping forces hold the electrode tip assemblies against their respective electrode bodies while the tip assemblies are attached to the electrode bodies. The attachment may include resistance and/or laser welding in one or more locations along an interface formed where the electrode tip assembly and electrode body meet. In the illustrated embodiment, the attachment includes two steps as indicated in FIGS. 9 and 10.

As illustrated in FIG. 9, tack welds 54' are formed to at least temporarily attach the electrode tip assemblies to the electrode bodies. The use of blade clamps 58 or other clamps having a slim-profile as shown can help accommodate welding equipment, such as laser tack welding equipment, because they utilize only a small portion of the area surrounding the electrode tip assemblies, thus making the remainder of the surrounding area accessible to the attachment equipment. In this case, laser tack welds 54' are formed on opposite sides of each of the blade clamp locations. Other types of welds may be used, as may other types of joining techniques, even temporary joining techniques that are suitable to hold the electrode tip assembly in place during subsequent tip assembly attachment step or steps. In some embodiments, the tack welding step may be sufficient for permanent attachment of the tip assembly to the electrode body.

Figure 10:
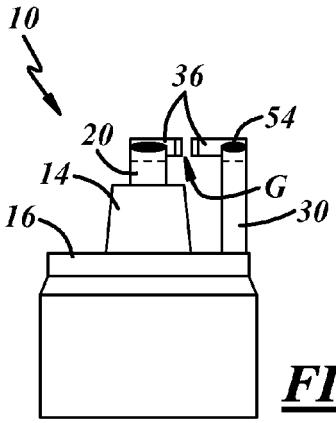
FIG. 10 is a front view of the firing end of the finished spark plug resulting from the subassemblies of FIGS. 6-9.

FIG. 10 shows the spark plug 10 after welds 54 are formed. Welds 54 in this embodiment are elongated welds located at an interface between each electrode tip assembly and its respective electrode body that may be formed by laser welding or any other suitable type of welding or metal joining technique. This welding step may be performed before or after the clamping forces are removed from the electrode tip assemblies or before or after the gap tool is removed from its location between the tip assemblies, where a gap tool is employed. In one embodiment, the tack welding step is omitted and the electrode tip assemblies are resistance and/or laser welded to the electrode bodies after the clamp load is applied and before the clamp load is removed.

Figure 11:
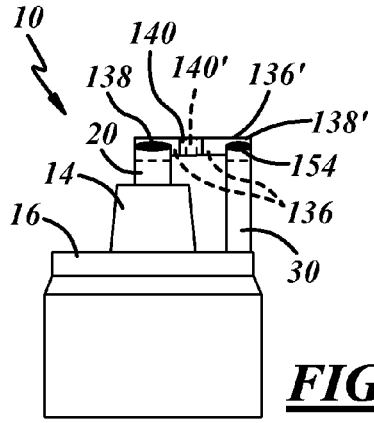
FIG. 11 is a front view of the firing end of another exemplary spark plug subassembly.

FIG. 11 illustrates another embodiment of a method of making a spark plug 10, that includes electrode tip assemblies located at axially-facing free end surfaces of electrode bodies. In this embodiment, the method includes the steps of welding first and second Ni-alloy pieces 138, 138' to opposite ends of an Ir-alloy piece 140 to form an electrode tip assembly preform 136' having a longitudinal axis. The method further includes welding the first Ni-alloy piece 138 to the axially-facing free end surface of the center electrode body so that the longitudinal axis of the pre-form is generally perpendicular to the longitudinal axis of the center electrode body and welding the second Ni-alloy piece 138' to the axially-facing free end surface of the ground electrode body as shown with welds 154. A step that includes cutting through the Ir-alloy piece 140 may then be performed to form separated electrode tip assemblies 136 having opposing sparking surfaces across a spark gap. The cutting step may be performed by any suitable cutting technique, and in this embodiment removes Ir-alloy segment 140', the ends of which are shown as dashed lines in the figure. A dual-ground electrode embodiment may be formed using a similar method, where the electrode tip preform includes two Ir-alloy pieces in alternating position with three Ni-alloy pieces, for example, and the two Ir-alloy pieces are cut to form dual spark gaps on opposite sides of the center electrode.

In embodiments such as those shown in FIGS. 1-5, where the spark gap G is an offset gap or a gap that is not located along the longitudinal axis of the center electrode body, it may be useful to construct the spark plug so that the spark gap can be repeatably located and/or oriented when installed for use in an engine or other application. For instance, when used with gasoline direct injection (GDI) engines, the location and/or alignment of the spark gap G relative to the fuel injector may be important for proper fuel ignition in some cases. In order to locate an offset spark gap in the desired location and/or orientation when installed for use, the ground electrode may be attached to the metallic shell at a location that corresponds to a rotational positioning feature of the spark plug assembly that is used to control the rotational position or orientation of the spark plug when installed. A rotational positioning feature 65 is shown schematically in FIG. 7, and is aligned with the ground electrode body 30 in that example. The rotational positioning feature 65 can be a rib, shoulder, recess, or some other type of mechanical stop constructed and arranged to prevent further rotation of the spark plug during installation once the spark gap is in the desired position. The positioning feature 65 need not be aligned with the ground electrode body. For example, the positioning feature 65 may be the beginning or ending point of external threads formed in the metallic shell, which could be angularly offset from the appropriate location of the ground electrode that effectively locates the spark gap when installed. In another example, the ground electrode may be attached to the metallic shell at a pre-determined location relative to a rotational positioning feature in the form of a line or mark or some other visual feature that a person installing the spark plug can align with another visual feature on the engine or that a vision system in a manufacturing facility can orient or align as desired. These are only examples of oriented ground electrode positioning, and other methods may be employed.

Figure 12:
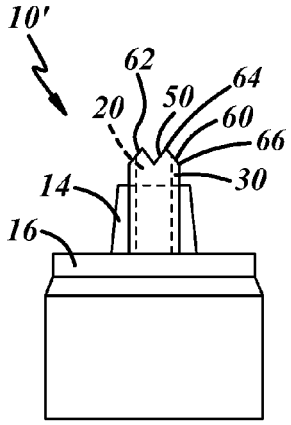
FIG. 12 is a side view of an exemplary spark plug subassembly, showing a V-shaped groove and a tapered portion.
Figure 13:
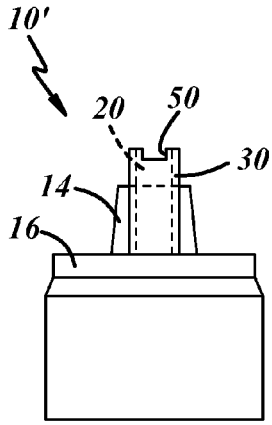
FIG. 13 is a side view of another exemplary spark plug subassembly, showing a rectangular groove.
Figure 14:
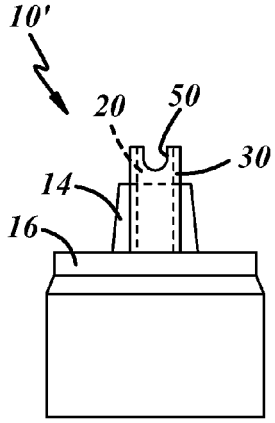
FIG. 14 is a side view of another exemplary spark plug subassembly, showing a U-shaped groove.

FIGS. 12-14 illustrate various configurations for electrode body free end surfaces, including various types of grooves 50 formed therein. These figures are all shown as side views of subassembly 10' (similar to FIG. 7) before the electrode tip assemblies are attached. As shown in FIG. 12, one or more of the ground or center electrode bodies may include free end surfaces without portions that are perpendicular to the central axis of the respective electrode body. For example, one or more of the electrode bodies may include a tapered portion 60 including surfaces 62 on either side of groove 50 at the electrode body free end. This configuration may further enhance fuel ignition. Surfaces 62 are angled with respect to the longitudinal axis of the electrode body in which they are formed. Each surface 62 of the tapered portion 60 shown in the example of FIG. 12 the groove 50 at a first end 64 and extends an axial distance that is about equal to the depth of the groove 50 to a second end 66. Though the free end surfaces depicted in FIG. 12 do not have portions that are perpendicular to the longitudinal axis of the respective electrode bodies, they are still considered axially-facing free end surfaces. The first end 64 of surface 62 does not have to coincide with the groove 50, as the free end surface may include a flat portion between the first end of taper surface 62 and the groove 50. Additionally, the second end 66 of surface 62 can lie anywhere along the length of the respective electrode body, and surface 62 may be curvilinear in profile. Tapered portion 60 may be formed by any suitable metal cutting or forming technique after the electrode body is assembled into subassembly 10' or it may be preformed. In one embodiment, it is formed in the same operation as the cutting operation depicted in FIG. 6. Tapered portion 60, while shown with a V-shaped groove 50 in this embodiment, may be included with any groove configuration, such as those shown in FIG. 13-15, or it may be included where groove 50 is omitted.

Figure 15:
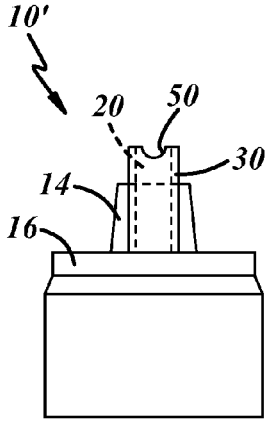
FIG. 15 is a side view of another exemplary spark plug assembly, showing a semi-circular groove.

FIG. 13 shows the groove 50 with a rectangular cross-section or in the form of a slot. In one embodiment, the depth of the slot 50 is about two-thirds of the diameter or cross-sectional width of the electrode tip assembly that it supports, but the depth of the slot may be more or less than that depending on the particular application. FIG. 14 shows the groove 50 with a U-shaped cross-section, configured so that the longitudinal axis of a cylindrical electrode tip assembly lies axially inboard of at least a portion of the respective free end surface when assembled. FIG. 15 shows groove 50 with a semi-circular cross section, configured so that the longitudinal axis of the tip assembly is axially positioned in line with the farthest outboard portion of the free-end surface when assembled. Other groove cross-sections are possible, as are other non-cylindrical tip assemblies.

Spark plugs constructed according to one or more of the structures and/or methods disclosed above may allow the use of expensive precious or noble metals, such as Ir-alloys, to be minimized by using such metals only where necessary—i.e., at the plug sparking surfaces. Spark gap accuracy may also be improved by positively setting the gap during manufacture without bending the ground electrode, which may be a more conventional technique to set the spark gap. For instance, including a bending process to set the spark gap may require over-bending due to spring-back of the electrode materials, leading to higher process variation. In addition, such bending may induce stresses in the electrode materials that may be at least partially relieved during high temperature operation of the spark plug, thereby causing the spark gap to increase or decrease in size during use. The use of electrodes as described above can also allow the ground electrode, in particular, to be made from a shorter piece of material than some other types of ground electrodes, thus allowing it to operate at an overall lower temperature and possibly reducing or eliminating the need for higher thermal conductivity cores, such as copper cores, within the electrode. Lower operating temperatures may also help to reduce electrode oxidation.

The use of grooves in the free end surfaces of the electrode bodies to position the electrode tip assemblies for attachment may result in more precise alignment of sparking surfaces across the spark gap, particularly where grooves are formed in the center and ground electrode bodies in the same manufacturing set-up after the bodies are already assembled with the insulator and metallic shell. In fact, setting the spark gap by positioning the electrode tip assemblies after all of the other spark plug components have already been assembled may eliminate multiple sources of variation that typically affect the accuracy of the spark gap with other types of designs and processes.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator, the center electrode comprising a center electrode body having a longitudinal axis and an axially-facing free end surface;

a ground electrode being attached to the metallic shell, the ground electrode comprising a ground electrode body having a longitudinal axis and an axially-facing free end surface; and an electrode tip assembly being attached to the axially-facing free end surface of the center electrode body or the ground electrode body and having a longitudinal axis that is generally perpendicular to the longitudinal axis of the respective electrode body to which it is attached, wherein the electrode tip assembly comprises an electrode tip body attached to the respective electrode body and a noble metal firing tip attached to the electrode tip body and facing a spark gap.

2. The spark plug of claim 1, wherein the electrode tip body is constructed from a Ni-alloy material and the noble metal firing tip is constructed from an Ir-alloy material.

3. The spark plug of claim 1, further comprising:

a second electrode tip assembly being attached to the axially-facing free end surface of the other of the center electrode body or the ground electrode body and having a longitudinal axis that is generally perpendicular to the longitudinal axis of the respective electrode body to which it is attached, wherein the second electrode tip assembly comprises a second electrode tip body attached to the respective electrode body and a second noble metal firing tip attached to the second electrode tip body and facing the spark gap.

4. The spark plug of claim 1, wherein the electrode tip assembly is attached to the ground electrode body, the spark plug further comprising:

a second ground electrode being attached to the metallic shell, the second ground electrode comprising a second ground electrode body having a longitudinal axis and an axially-facing free end surface; and a second electrode tip assembly being attached to the axially-facing free end surface of the second ground electrode body and having a longitudinal axis that is generally perpendicular to the longitudinal axis of the second ground electrode body, wherein the second electrode tip assembly comprises a second electrode tip body attached to the second electrode body and a second noble metal firing tip attached to the second electrode tip body and facing a second spark gap.

5. The spark plug of claim 4, further comprising:

a third electrode tip assembly being attached to the axially-facing free end surface of the center electrode body and having a longitudinal axis that is generally perpendicular to the longitudinal axis of the center electrode body, wherein the third electrode tip assembly comprises a third electrode tip body attached to the center electrode body and separate noble metal firing tips attached to opposite ends of the third electrode tip body, wherein the longitudinal axes of the three electrode tip assemblies are generally aligned with one another so that each noble metal tip of the third electrode tip assembly faces one of the spark gaps.

6. The spark plug of claim 1, wherein the electrode tip assembly is located along a groove formed in the axially-facing free end surface of the respective electrode body, the groove having a longitudinal axis that is generally parallel to the longitudinal axis of the electrode tip assembly.

7. The spark plug of claim 6, wherein the groove has a cross-section that is rectangular, V-shaped, U-shaped, or semi-circular.

8. The spark plug of claim 1, wherein one or both of the electrode bodies includes a tapered portion having a surface that partly defines the axially-facing free end surface(s).

9. The spark plug of claim 1, wherein the ground electrode is attached to the metallic shell at a location corresponding to a rotational positioning feature.

10. A method of making a spark plug, comprising the steps of:

(a) providing a Ni-alloy piece, an Ir-alloy piece, and an electrode body, the electrode body having a longitudinal axis;

(b) welding the Ni-alloy piece and the Ir-alloy piece together to form an electrode tip assembly having a longitudinal axis; and (c) welding the Ni-alloy piece to an axially-facing free end surface of the electrode body so that the longitudinal axis of the electrode tip assembly is generally perpendicular to the longitudinal axis of the electrode body.

11. The method of claim 10, further comprising the step of:

forming a groove in the axially-facing free end surface of the electrode body for supporting the electrode tip assembly during step (c).

12. The method of claim 11, further comprising the step of:

forming a tapered portion in the electrode body having surfaces on either side of the groove that partly define the axially-facing end surface of the electrode body.

13. The method of claim 10, further comprising the step of:

adjusting the location of the electrode tip assembly in a direction along the longitudinal axis of the electrode tip assembly before step (c) to form a spark gap of the desired size between the Ir-alloy piece and another electrode of the spark plug.

14. The method of claim 10, further comprising the steps of:

providing a center electrode body and a ground electrode body, each electrode body having a free end; and removing material from one or both of the electrode body free ends so that the electrode bodies have axially-facing free end surfaces in the same plane.

15. A method of making a spark plug, comprising the steps of:

(a) welding first and second Ni-alloy pieces to opposite ends of an Ir-alloy piece to form an electrode tip assembly pre-form having a longitudinal axis;

(b) welding the first Ni-alloy piece to an axially-facing free end surface of a center electrode body so that the longitudinal axis of the pre-form is generally perpendicular to a longitudinal axis of the center electrode body;

(c) welding the second Ni-alloy piece to an axially-facing free end of a ground electrode body; and (d) cutting through the Ir-alloy piece to form separate electrode tip assemblies having opposing sparking surfaces separated by a spark gap.

* * * * *